US007738665B2

(12) United States Patent
Dijkstra et al.

(10) Patent No.: US 7,738,665 B2
(45) Date of Patent: Jun. 15, 2010

(54) METHOD AND SYSTEM FOR PROVIDING HEARING ASSISTANCE TO A USER

(75) Inventors: Evert Dijkstra, Fontaines (CH); Francois Marquis, Oron-le-Chatel (CH)

(73) Assignee: Phonak Communications AG, Murten (CH)

( * ) Notice: Subject to any disclaimer, the term of this patent is extended or adjusted under 35 U.S.C. 154(b) by 1049 days.

(21) Appl. No.: 11/421,527

(22) Filed: Jun. 1, 2006

(65) Prior Publication Data

US 2007/0189561 A1 Aug. 16, 2007

(30) Foreign Application Priority Data

Feb. 13, 2006 (EP) ..... 06002886

(51) Int. Cl.
*H04R 25/00* (2006.01)

(52) U.S. Cl. ..... 381/315; 381/312; 381/321

(58) Field of Classification Search ..... 381/23.1, 381/60, 312, 314, 315, 320, 321; 704/200.1, 704/271; 455/575.1, 575.6
See application file for complete search history.

(56) References Cited

U.S. PATENT DOCUMENTS 5,511,128 A 4/1996 Lindemann
5,721,783 A * 2/1998 Anderson ..... 381/328
5,734,976 A 3/1998 Bartschi et al.
6,895,098 B2 5/2005 Allegro et al.
6,910,013 B2 6/2005 Allegro et al.
7,343,023 B2 * 3/2008 Nordqvist et al. ..... 381/321
2002/0150264 A1 10/2002 Allegro et al.

FOREIGN PATENT DOCUMENTS

| | | | |
|---|---|---|---|
| CA | 2439427 | A1 | 4/2002 |
| EP | 0563194 | B1 | 3/2002 |
| EP | 1619926 | A1 | 1/2006 |
| GB | 1 565 701 | | 4/1980 |
| WO | 97/21325 | A1 | 6/1997 |
| WO | 01/76321 | A1 | 10/2001 |
| WO | 02/30153 | A1 | 4/2002 |
| WO | 2004/100607 | A1 | 11/2004 |

* cited by examiner

*Primary Examiner*—Huyen D Le
(74) *Attorney, Agent, or Firm*—David S. Safran; Roberts Mlotkowski Safran & Cole, P.C.

(57) ABSTRACT

There is provided a method for providing hearing assistance to a user (101), comprising capturing audio signals by a microphone arrangement (26) and transmitting the audio signals by a transmission unit (102) via a wireless audio link (107) to a receiver unit (103), analyzing the audio signals by a classification unit (134) prior to being transmitted in order to determine a present auditory scene category from a plurality of auditory scene categories, setting by a gain control unit (126) located in the receiver unit (103) the gain applied to the audio signals according to the present auditory scene category determined by the classification unit, and stimulating the user's hearing by stimulating means (136) worn at or in a user's ear according to the audio signals from the gain control unit (126).

58 Claims, 7 Drawing Sheets

METHOD AND SYSTEM FOR PROVIDING HEARING ASSISTANCE TO A USER

BACKGROUND OF THE INVENTION

1. Field of the Invention

The present invention relates to a method for providing hearing assistance to a user; it also relates to a corresponding system. In particular, the invention relates to a system comprising a transmission unit comprising a microphone arrangement for capturing audio signals, a receiver unit, and means for stimulating the hearing of the user wearing the receiver unit, with the audio signals being transmitted via a wireless audio link from the transmission unit to the receiver unit.

2. Description of Related Art

Usually in such systems the wireless audio link is an FM radio link. The benefit of such systems is that sound captured by a remote microphone at the transmission unit can be presented at a high sound pressure level to the hearing of the user wearing the receiver unit at his ear(s).

According to one typical application of such wireless audio systems, the stimulating means is a loudspeaker which is part of the receiver unit or is connected thereto. Such systems are particularly helpful for being used in teaching normal-hearing children suffering from auditory processing disorders (APD), wherein the teacher's voice is captured by the microphone of the transmission unit, and the corresponding audio signals are transmitted to and are reproduced by the receiver unit worn by the child, so that the teacher's voice can be heard by the child at an enhanced level, in particular with respect to the background noise level prevailing in the classroom. It is well known that presentation of the teacher's voice at such enhanced level supports the child in listening to the teacher.

Usually in such systems the audio signals received by the receiver are amplified at a given constant gain for being reproduced by the output transducer. FIG. 5 shows an example of a block diagram of such a conventional receiver unit 103 comprising an antenna 123, an FM radio receiver 124, an amplifier 138 operating at constant gain, a power audio amplifier 137 for a loudspeaker 136, and a manual volume control 135 acting on the power amplifier 137. Such receiver unit has as a drawback that due to the constant gain the audio signals received from the remote microphone are amplified irrespective of whether they are desired by the user (e.g. if the teacher is silent there is no benefit to the user by receiving audio signals from the remote microphone, which then may consist primarily of noise).

According to another typical application of wireless audio systems the receiver unit is connected to or integrated into a hearing instrument, such as a hearing aid. The benefit of such systems is that the microphone of the hearing instrument can be supplemented or replaced by the remote microphone which produces audio signals which are transmitted wirelessly to the FM receiver and thus to the hearing instrument. In particular, FM systems have been standard equipment for children with hearing loss in educational settings for many years. Their merit lies in the fact that a microphone placed a few inches from the mouth of a person speaking receives speech at a much higher level than one placed several feet away. This increase in speech level corresponds to an increase in signal-to-noise ratio (SNR) due to the direct wireless connection to the listener's amplification system. The resulting improvements of signal level and SNR in the listener's ear are recognized as the primary benefits of FM radio systems, as hearing-impaired individuals are at a significant disadvantage when processing signals with a poor acoustical SNR.

Most FM systems in use today provide two or three different operating modes. The choices are to get the sound from: (1) the hearing instrument microphone alone, (2) the FM microphone alone, or (3) a combination of FM and hearing instrument microphones together.

Usually, most of the time the FM system is used in mode (3), i.e. the FM plus hearing instrument combination (often labeled "FM+M" or "FM+ENV" mode). This operating mode allows the listener to perceive the speaker's voice from the remote microphone with a good SNR while the integrated hearing instrument microphone allows to listener to also hear environmental sounds. This allows the user/listener to hear and monitor his own voice, as well as voices of other people or environmental noise, as long as the loudness balance between the FM signal and the signal coining from the hearing instrument microphone is properly adjusted. The so-called "FM advantage" measures the relative loudness of signals when both the FM signal and the hearing instrument microphone are active at the same time. As defined by the ASHA (American Speech-Language-Hearing Association 2002), FM advantage compares the levels of the FM signal and the local microphone signal when the speaker and the user of an FM system are spaced by a distance of two meters. In this example, the voice of the speaker will travel 30 cm to the input of the FM microphone at a level of approximately 80 dB-SPL, whereas only about 65 dB-SPL will remain of this original signal after traveling the 2 m distance to the microphone in the hearing instrument. The ASHA guidelines recommend that the FM signal should have a level 10 dB higher than the level of the hearing instrument's microphone signal at the output of the user's hearing instrument.

When following the ASHA guidelines (or any similar recommendation), the relative gain, i.e. the ratio of the gain applied to the audio signals produced by the FM microphone and the gain applied to the audio signals produced by the hearing instrument microphone, has to be set to a fixed value in order to achieve e.g. the recommended FM advantage of 10 dB under the above-mentioned specific conditions. Accordingly, heretofore—depending on the type of hearing instrument used—the audio output of the FM receiver has been adjusted in such a way that the desired FM advantage is either fixed or programmable by a professional, so that during use of the system the FM advantage—and hence the gain ratio—is constant in the FM+M mode of the FM receiver.

EP 0 563 194 B1 relates to a hearing system comprising a remote microphone/transmitter unit, a receiver unit worn at the user's body and a hearing aid. There is radio link between the remote unit and the receiver unit, and there is an inductive link between the receiver unit and the hearing aid. The remote unit and the receiver unit each comprise a microphone, with the audio signals of theses two microphones being mixed in a mixer. A variable threshold noise-gate or voice-operated circuit may be interposed between the microphone of the receiver unit and the mixer, which circuit is primarily to be used if the remote unit is in a line-input mode, i.e. the microphone of the receiver then is not used.

WO 97/21325 A1 relates to a hearing system comprising a remote unit with a microphone and an FM transmitter and an FM receiver connected to a hearing aid equipped with a microphone. The hearing aid can be operated in three modes, i.e. "hearing aid only", "FM only" or "FM+M". In the FM+M mode the maximum loudness of the hearing aid microphone audio signal is reduced by a fixed value between 1 and 10 dB below the maximum loudness of the FM microphone audio signal, for example by 4 dB. Both the FM microphone and the hearing aid microphone may be provided with an automatic gain control (AGC) unit.

WO 2004/100607 A1 relates to a hearing system comprising a remote microphone, an FM transmitter and left-and right-ear hearing aids, each connected with an FM receiver. Each hearing aid is equipped with a microphone, with the audio signals from remote microphone and the respective hearing aid microphone being mixed in the hearing aid. One of the hearing aids may be provided with a digital signal processor which is capable of analyzing and detecting the presence of speech and noise in the input audio signal from the FM receiver and which activates a controlled inverter if the detected noise level exceeds a predetermined limit when compared to the detected level, so that in one of the two hearing aids the audio signal from the remote microphone is phase-inverted in order to improve the SNR.

WO 02/30153 A1 relates to a hearing system comprising an FM receiver connected to a digital hearing aid, with the FM receiver comprising a digital output interface in order to increase the flexibility in signal treatment compared to the usual audio input parallel to the hearing aid microphone, whereby the signal level can easily be individually adjusted to fit the microphone input and, if needed, different frequency characteristics can be applied. However, is not mentioned how such input adjustment can be done.

Contemporary digital hearing aids are capable of permanently performing a classification of the present auditory scene captured by the hearing aid microphones in order to select the hearing aid operation mode which is most appropriate for the determined present auditory scene. Examples for such hearing aids with auditory scene analyses can be found in US2002/0037087, US2002/0090098, CA 2 439 427 A1 and US2002/0150264.

Usually FM or inductive receivers are equipped with a squelch function by which the audio signal in the receiver is muted if the level of the demodulated audio signal is too low in order to avoid user's perception of excessive noise due a too low sound pressure level at the remote microphone or due to a large distance between the transmission unit and the receiver unit exceeding the reach of the FM link, see for example U.S. Pat. No. 5,734,976 and EP 1 619 926 A1

It is an object of the invention to provide for a method and a system for providing hearing assistance to a user, wherein a remote microphone arrangement coupled by a wireless audio link to a receiver unit which provides the audio signals to means for stimulating the hearing of the user wearing the receiver unit is used and wherein the listening comfort, and in particular the signal-to-noise-ratio (SNR), of the audio signals from the microphone arrangement should be optimized at any time.

It is a further object of the invention to provide for a method and a system for providing hearing assistance to a user, wherein a remote first microphone arrangement coupled by a wireless audio link to a hearing instrument and a second microphone arrangement connected to or integrated into the hearing instrument are used and wherein the SNR of the audio signals from at least one of the first and second microphone arrangement should be optimized at any time.

According to the invention, these objects achieved by a method as defined in claim 1 and a system as defined in claim 55, and by a method as defined in claim 33 and a system as defined in claim 57, respectively.

SUMMARY OF THE INVENTION

The aspect of the invention according to claims 1 and 55 is beneficial in that by permanently analyzing the captured audio signals by a classification unit in order to determine the present auditory scene category and by setting the gain applied to the audio signals according to the thus determined present auditory scene category, the gain applied to the audio signals can be permanently optimized according to the present auditory scene in order to provide the user of the receiver unit with a stimulus having an optimized SNR according to the present auditory scene. In other words, the level of the audio signals can be optimized according to the present auditory scene. This is a significant improvement over conventional systems provided with a remote microphone wherein the gain of the remote microphone audio signals has a fixed value which does not depend on the present auditory scene and hence inherently is optimized only for one certain auditory scene.

On the one hand, the invention is beneficial for applications in which the stimulating means is part of the receiver unit or directly connected thereto. In this case the stimulating means will reproduce only the audio signals from the receiver unit.

On the other hand, the invention is also beneficial for applications in which the receiver unit is part of a hearing instrument or is connected thereto. In this case there will be second audio signals from the microphone of the hearing instrument with which the audio signals from the receiver unit may be mixed prior to being reproduced by the stimulating means. Usually the audio signals from the receiver unit and the hearing instrument microphone will be mixed in the hearing instrument in such a manner that they are processed and power-amplified together so that gain applied to these audio signals in the hearing instrument is the same for both kinds of audio signals; consequently, after mixing the gain ratio will not be changed by the usual dynamic audio signal processing of the hearing instrument. Thus, by controlling the gain applied to the audio signals from the remote microphone arrangement by the gain control unit of the receiver unit, also the gain ratio, i.e. the ratio of the gain applied to the audio signals from the remote microphone arrangement and the gain applied to the audio signals from the hearing instrument microphone, can be controlled according to the result of the auditory scene analysis. Thereby the "FM advantage" can be dynamically adapted to the present auditory scene.

The aspect of the invention according to claims 33 and 57 is beneficial in that by permanently analyzing at least one of the first and second audio signals by a classification unit in order to determine the present auditory scene category and by setting the relative gain applied to the first and second audio signals, respectively, according to the thus determined present auditory scene category, the relative gain, i.e. the ratio of the gain applied to the first audio signals and the gain applied to a second audio signals, can be permanently optimized according to the present auditory scene in order to provide the user of the hearing instrument with a stimulus having an optimized SNR according to the present auditory scene. In other words, the level of the first audio signals and the level of the second audio signals can be optimized according to the present auditory scene. This is a significant improvement over conventional systems provided with a remote microphone wherein the gain ratio of the remote microphone audio signals and the hearing instrument microphone audio signals has a fixed value which does not depend on the present auditory scene and hence inherently is optimized only for one certain auditory scene.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

A first example of the invention is illustrated in FIGS. 1 to 4 and 6 and 7.

Figure 1:
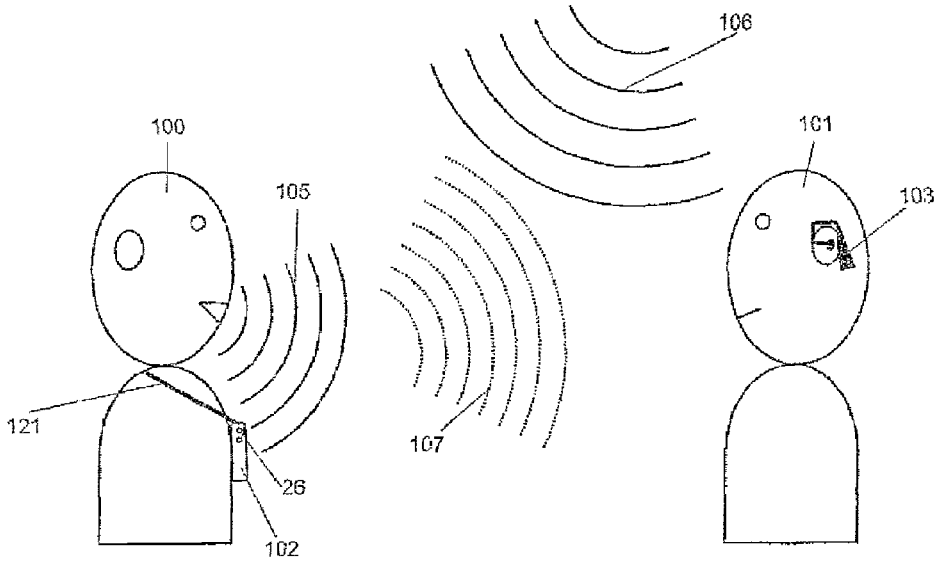
FIG. 1 is a schematic view of the use of a first embodiment of a hearing assistance system according to the invention.
Figure 6:
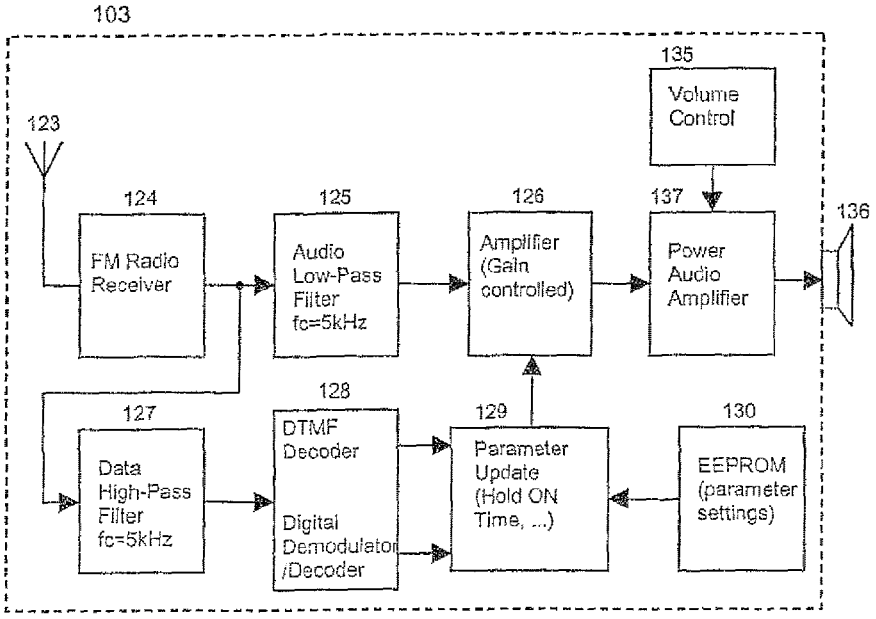
FIG. 6 is a block diagram of the receiver unit of the system of FIG. 1.

FIG. 1 shows schematically the use of a system for hearing assistance comprising an FM radio transmission unit 102 comprising a directional microphone arrangement 26 consisting of two omnidirectional microphones M1 and M2 which are spaced apart by a distance d, and an FM radio receiver unit 103 comprising a loudspeaker 136 (shown only in FIG. 6). The transmission unit 102 is worn by a speaker 100 around his neck by a neck-loop 121 acting as an FM radio antenna, with the microphone arrangement 26 capturing the sound waves 105 carrying the speaker's voice. Audio signals and control data are sent from the transmission unit 102 via radio link 107 to the receiver unit 103 worn by a user/listener 101. In addition to the voice 105 of the speaker 100 background/surrounding noise 106 may be present which will be both captured by the microphone arrangement 26 of the transmission unit 102 and the ears of the user 101. Typically the speaker 100 will be a teacher and the user 101 will be a normal-hearing child suffering from APD, with background noise 106 being generated by other pupils.

Figure 2:
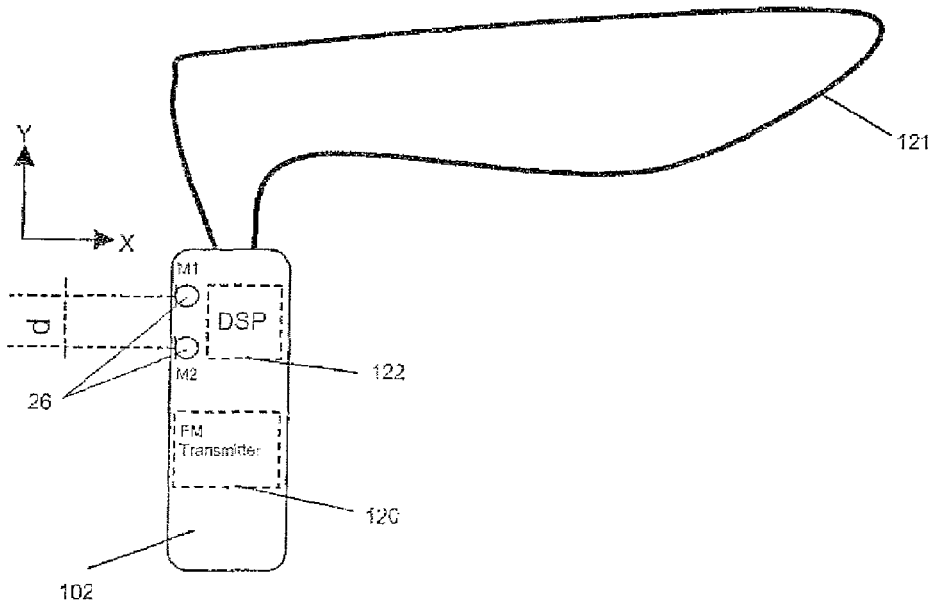
FIG. 2 is a schematic view of the transmission unit of the system of FIG. 1.

FIG. 2 is a schematic view of the transmission unit 102 which, in addition to the microphone arrangement 26, comprises a digital signal processor 122 and an FM transmitter 120.

Figure 3:
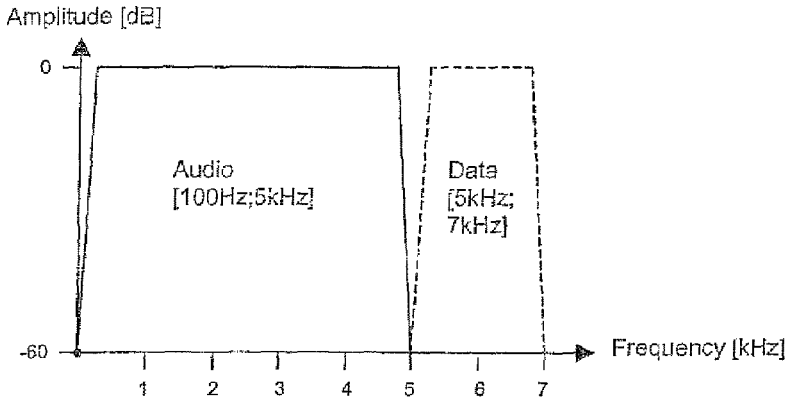
FIG. 3 is a diagram showing the signal amplitude versus frequency of the common audio signal/data transmission channel of the system of FIG. 1.

According to FIG. 3, the channel bandwidth of the FM radio transmitter 120, which, for example, may range from 100 Hz to 7 kHz, is split in two parts ranging, for example from 100 Hz to 5 kHz and from 5 kHz to 7 kHz, respectively. In this case, the lower part is used to transmit the audio signals (i.e. the first audio signals) resulting from the microphone arrangement 26, while the upper part is used for transmitting data from the FM transmitter 120 to the receiver unit 103. The data link established thereby can be used for transmitting control commands relating to the gain to be set by the receiver unit 103 from the transmission unit 102 to the receiver unit 103, and it also can be used for transmitting general information or commands to the receiver unit 103.

Figure 4:
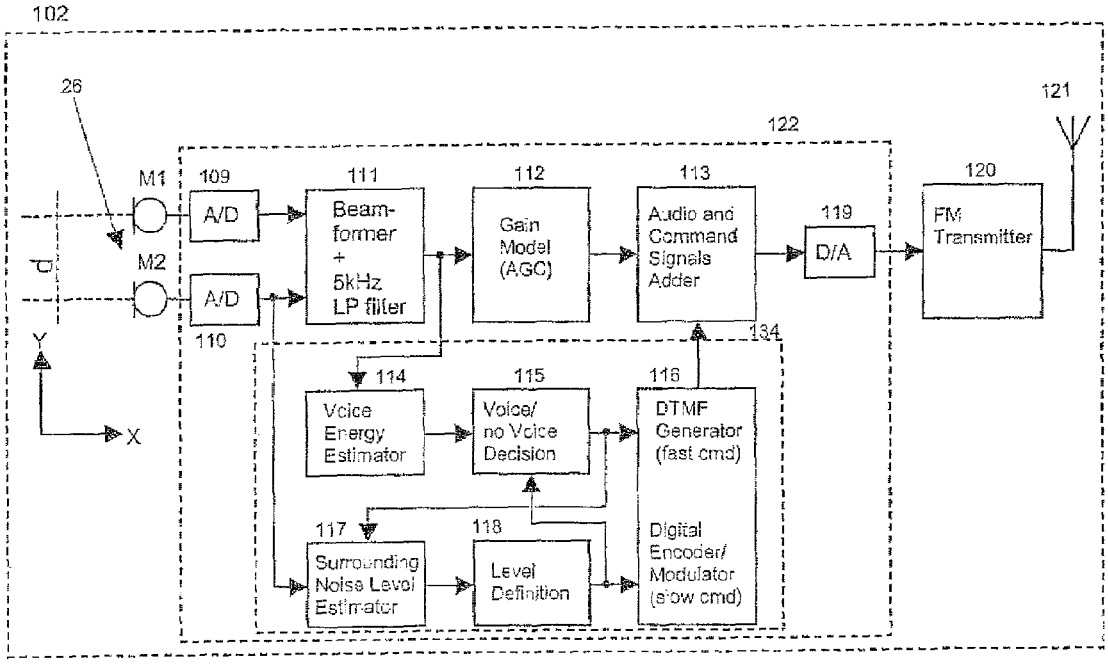
FIG. 4 is a block diagram of the transmission unit of the system of FIG. 1.
Figure 5:
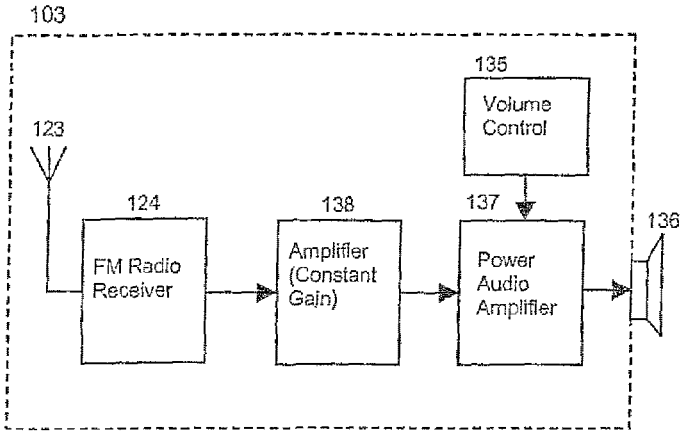
FIG. 5 is a block diagram of a conventional receiver unit.

The internal architecture of the FM transmission unit 102 is schematically shown in FIG. 4. As already mentioned above, the spaced apart omnidirectional microphones M1 and M2 of the microphone arrangement 26 capture both the speaker's voice 105 and the surrounding noise 106 and produce corresponding audio signals which are converted into digital signals by the analog-to-digital converters 109 and 110. M1 is the front microphone and M2 is the rear microphone. The microphones M1 and M2 together associated to a beamformer algorithm form a directional microphone arrangement 26 which, according to FIG. 1, is placed at a relatively short distance to the mouth of the speaker 100 in order to insure a good SNR at the audio source and also to allow the use of easy to implement and fast algorithms for voice detection as will be explained in the following. The converted digital signals from the microphones M1 and M2 are supplied to the unit 111 which comprises a beam former implemented by a classical beam former algorithm and a 5 kHz low pass filter. The first audio signals leaving the beam former unit 111 are supplied to a gain model unit 112 which mainly consists of an automatic gain control (AGC) for avoiding an overmodulation of the transmitted audio signals. The output of a gain model unit 112 is supplied to an adder unit 113 which mixes the first audio signals, which are limited to a range of 100 Hz to 5 kHz due to the 5 kHz low pass filter in the unit 111, and data signals supplied from a unit 16 within a range from 5 kHz and 7 kHz. The combined audio/data signals are converted to analog by a digital-to-analog converter 119 and then are supplied to the FM transmitter 120 which uses the neck-loop 121 as an FM radio antenna.

The transmission unit 102 comprises a classification unit 134 which includes units 114, 115, 116, 117 and 118, as will be explained in detail in the following.

The unit 114 is a voice energy estimator unit which uses the output signal of the beam former unit 111 in order to compute the total energy contained in the voice spectrum with a fast attack time in the range of a few milliseconds, preferably not more than 10 milliseconds. By using such short attack time it is ensured that the system is able to react very fast when the speaker 100 begins to speak. The output of the voice energy estimator unit 114 is provided to a voice judgement unit 115 which decides, depending on the signal provided by the voice energy estimator 114, whether close voice, i.e. the speaker's voice, is present at the microphone arrangement 26 or not.

The unit 117 is a surrounding noise level estimator unit which uses the audio signal produced by the omnidirectional rear microphone M2 in order to estimate the surrounding noise level present at the microphone arrangement 26. However, it can be assumed that the surrounding noise level estimated at the microphone arrangement 26 is a good indication also for the surrounding noise level present at the ears of the user 101, like in classrooms for example. The surrounding noise level estimator unit 117 is active only if no close voice is presently detected by the voice judgement unit 115 (in case that close voice is detected by the voice judgement unit 115, the surrounding noise level estimator unit 117 is disabled by a corresponding signal from the voice judgment unit 115). A very long time constant in the range of 10 seconds is applied by the surrounding noise level estimator unit 117. The surrounding noise level estimator unit 117 measures and analyzes the total energy contained in the whole spectrum of the audio signal of the microphone M2 (usually the surrounding noise in a classroom is caused by the voices of other pupils in the classroom). The long time constant ensures that only the time-averaged surrounding noise is measured and analyzed, but not specific short noise events. According to the level estimated by the unit 117, a hysteresis function and a level definition is then applied in the level definition unit 118, and the data provided by the level definition unit 118 is supplied to the unit 116 in which the data is encoded by a digital encoder/modulator and is transmitted continuously with a digital modulation having a spectrum a range between 5 kHz and 7 kHz. That kind of modulation allows only relatively low bit rates and is well adapted for transmitting slowly varying parameters like the surrounding noise level provided by the level definition unit 1118.

The estimated surrounding noise level definition provided by the level definition unit 118 is also supplied to the voice judgement unit 115 in order to be used to adapt accordingly to it the threshold level for the close voice/no close voice decision made by the voice judgement unit 115 in order to maintain a good SNR for the voice detection.

If close voice is detected by the voice judgement unit 115, a very fast DTMF (dual-tone multi-frequency) command is generated by a DTMF generator included in the unit 116. The DTMF generator uses frequencies in the range of 5 kHz to 7 kHz. The benefit of such DTMF modulation is that the generation and the decoding of the commands are very fast, in the range of a few milliseconds. This feature is very important for being able to send a very fast "voice ON" command to the receiver unit 103 in order to catch the beginning of a sentence spoken by the speaker 100. The command signals produced in the unit 116 (i.e. DTMF tones and continuous digital modulation) are provided to the adder unit 113, as already mentioned above.

The units 109 to 119 all can be realized by the digital signal processor 122 of the transmission unit 102.

The receiver unit 103 is schematically shown in FIG. 6. The audio signals produced by the microphone arrangement 26 and processed by the units 111 and 112 of transmission unit 102 and the command signals produced by the classification unit 134 of the transmission unit 102 are transmitted from the transmission unit 102 over the same FM radio channel to the receiver unit 103 where the FM radio signals are received by the antenna 123 and are demodulated in an FM radio receiver 124. An audio signal low pass filter 125 operating at 5 kHz supplies the audio signals to an amplifier 126 from where the audio signals are supplied to a power audio amplifier 137 which further amplifies the audio signals for being supplied to the loudspeaker 136 which converts the audio signal into sound waves stimulation the user's hearing. The power amplifier 137 is controlled by a manually operable volume control 135. The output signal of the FM radio receiver 124 is also filtered by a high pass filter 127 operating at 5 kHz in order to extract the commands from the unit 116 contained in the FM radio signal. A filtered signal is supplied to a unit 129 including a DTMF decoder and a digital demodulator/decoder in order to decode the command signals from the voice judgement unit 115 and the surrounding noise level definition unit 118.

The command signals decoded in the unit 128 are provided separately to a parameter update unit 129 in which the parameters of the commands are updated according to information stored in an EEPROM 130 of the receiver unit 103. The output of the parameter update unit 129 is used to control the audio signal amplifier 126 which is gain controlled. Thereby the audio signal output of the amplifier 126—and thus the sound pressure level at which the audio signals are reproduced by the loudspeaker 136—can be controlled according to the result of the auditory scene analysis performed in the classification unit 134 in order to control the gain applied to the audio signals from the microphone arrangement 26 of the transmission unit 102 according to the present auditory scene category determined by the classification unit 134.

Figure 7:
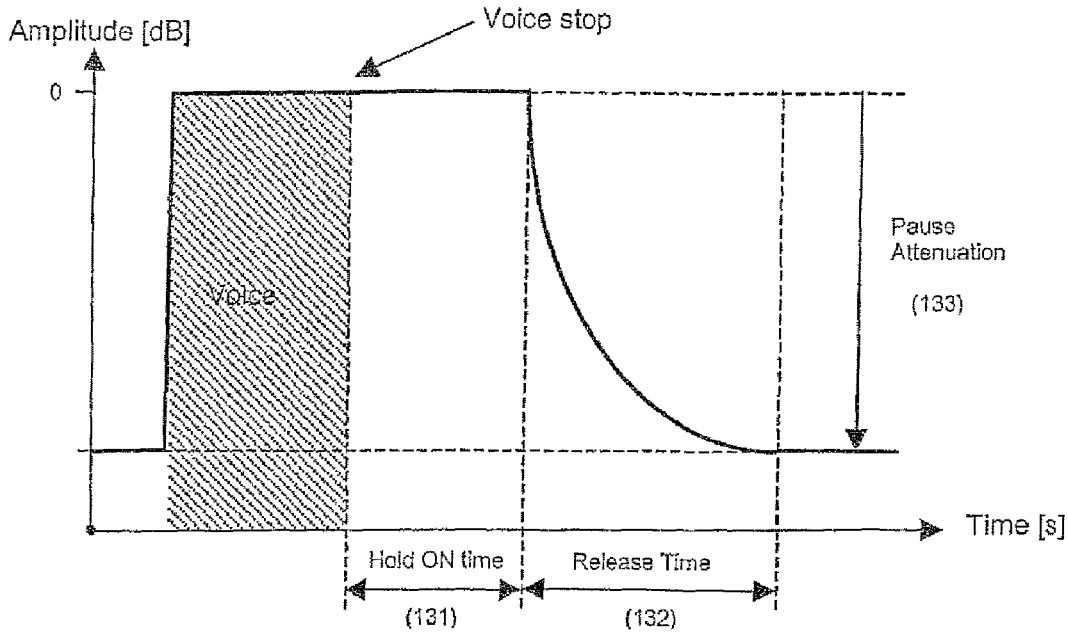
FIG. 7 is a diagram showing an example of the gain set by the gain control unit versus time.

FIG. 7 illustrates an example of how the gain set by the receiver unit 103 may be controlled according to the determined present auditory scene category.

As already explained above, the voice judgement unit 115 provides at its output for a parameter signal which may have two different values:

"Voice ON": This value is provided at the output if the voice judgement unit 115 has decided that close voice is present at the microphone arrangement 26. In this case, fast DTMF modulation occurs in the unit 116 and a control command is issued by the unit 116 and is transmitted to the amplifier 126, according to which the gain is set to a given value.

"Voice OFF": If the voice judgement unit 115 decides that no close voice is present at the microphone arrangement 26, a "voice OFF" command is issued by the unit 116 and is transmitted to the amplifier 126. In this case, the parameter update unit 129 applies a "hold on time" constant 131 and then a "release time" constant 132 defined in the EEPROM 130 to the amplifier 126. During the "hold on time" the gain set by the amplifier 126 remains at the value applied during "voice ON". During the "release time" the gain set by the amplifier 126 is progressively reduced from the value applied during "voice ON" to a lower value corresponding to a "pause attenuation" value 133 stored in the EEPROM 130. Hence, in case of "voice OFF" the gain of the microphone arrangement 26 is reduced relative to the gain of the microphone arrangement 26 during "voice ON". This ensures an optimum SNR of the sound signals present at the user's ear, since at that time no useful audio signal is present at the microphone arrangement 26 of the transmission unit 102, so that user 101 may perceive ambient sound signals (for example voice from his neighbor in the classroom) without disturbance by noise of the microphone arrangement 26.

The control data/command issued by the surrounding noise level definition unit 18 is the "surrounding noise level" which has a value according to the detected surrounding noise level. As already mentioned above, according to one embodiment the "surrounding noise level" is estimated only during "voice OFF" but the level values are sent continuously over the data link. Depending on the "surrounding noise level" the parameter update unit 129 controls the amplifier 126 such that according to the definition stored in the EEPROM 130 the amplifier 126 applies an additional gain offset to the audio signals sent to the power amplifier 137. According to alternative embodiments, the "surrounding noise level" is estimated only or also during "voice ON". In these cases, during "voice ON", the parameter update unit 129 controls the amplifier 126 depending on the "surrounding noise level" such that according to the definition stored in the EEPROM 130 the amplifier 126 applies an additional gain offset to the audio signals sent to the power amplifier 137.

The difference of the gain values applied for "voice ON" and "voice OFF", i.e. the dynamic range, usually will be less than 20 dB, e.g. 12 dB.

In all embodiments, the present auditory scene category determined by the classification unit 134 may be characterized by a classification index.

In general, the classification unit will analyze the audio signals produced by the microphone arrangement 26 of the transmission unit 102 in the time domain and/or in the frequency domain, i.e. it will analyze at least one of the following: amplitudes, frequency spectra and transient phenomena of the audio signals.

Figure 8:
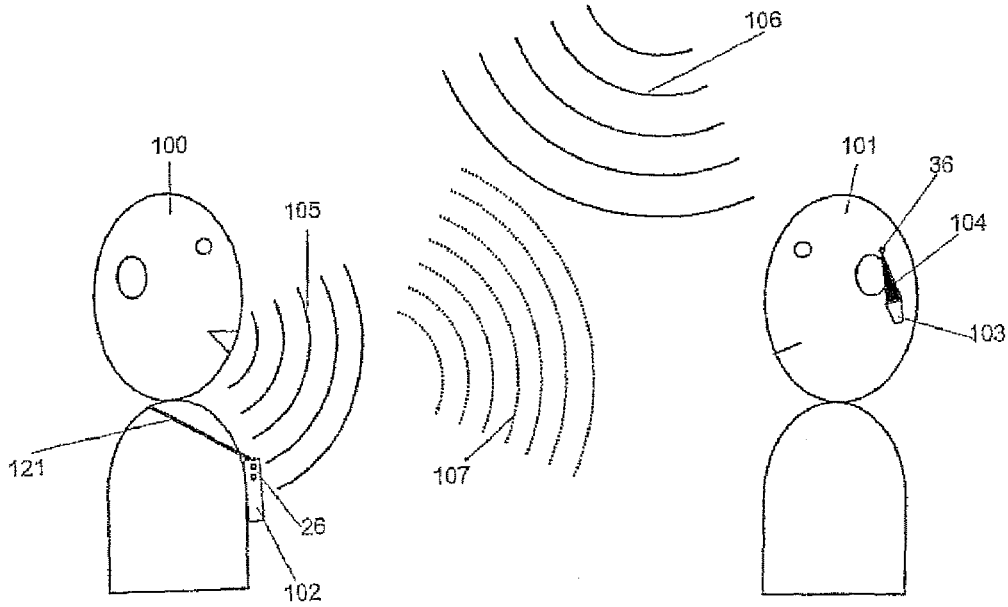
FIG. 8 is a schematic view of the use of a second embodiment of a hearing assistance system according to the invention.

FIG. 8 shows schematically the use of an alternative embodiment of a system for hearing assistance, wherein the receiver unit 103 worn by the user 101 does not comprise an electroacoustic output transducer but rather it comprises an audio output which is connected, e.g. by an audio shoe (not shown), to an audio input of a hearing instrument 104, e.g. a hearing aid, comprising a microphone arrangement 36. The hearing aid could be of any type, e.g. BTE (Behind-the-ear), ITE (In-the-ear) or CIC (Completely-in-the-channel).

Figure 9:
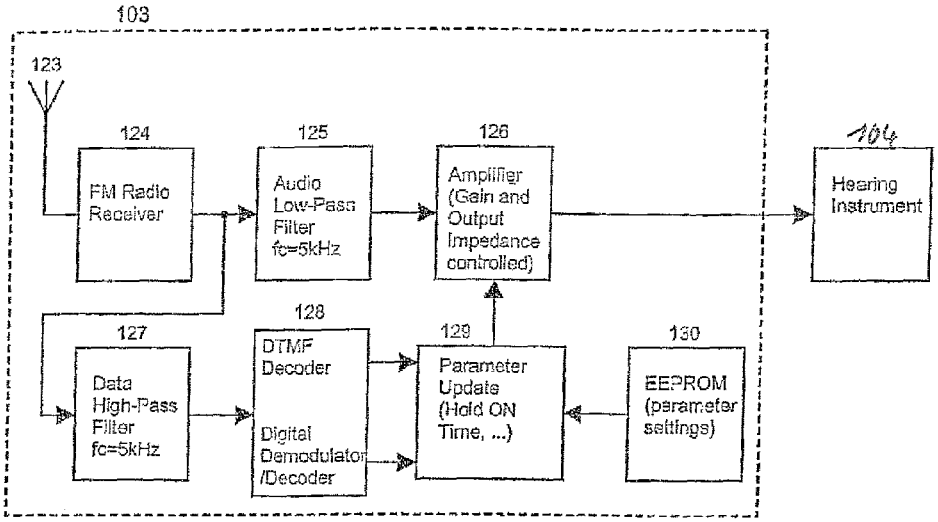
FIG. 9 is a block diagram of the receiver unit of the system of FIG. 8.

In FIG. 9 a block diagram of the receiver unit 103 connected to the hearing instrument 104 is shown. Apart from the features that the amplifier 126 is both gain and output impedance controlled and that the power amplifier 137, the volume control 135 and the loudspeaker 136 are replaced by an audio output, the architecture of the receiver unit 103 of FIG. 9 corresponds to that of FIG. 6.

Figure 10:
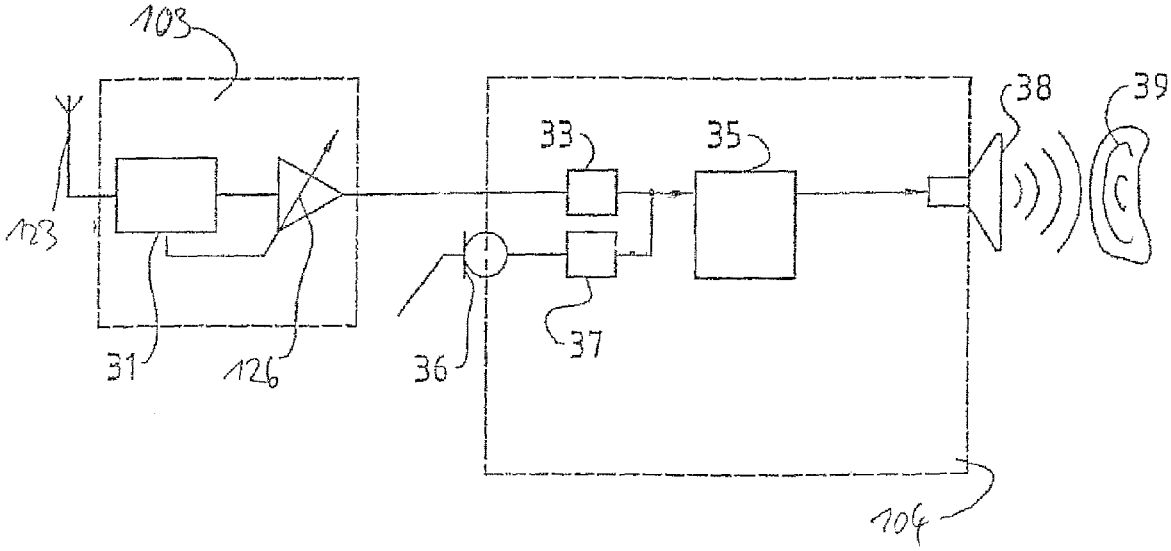
FIG. 10 shows schematically an example in which the receiver unit is connected to a separate audio input of a hearing instrument.

FIG. 10 is a block diagram of an example in which the receiver unit 103 is connected to a high impedance audio input of the hearing instrument 104. In FIG. 10 the signal processing units of the receiver unit 103 of FIG. 9 are schematically represented by a module 31. The processed audio signals are amplified by the variable gain amplifier 126. The output of the receiver unit 103 is connected to an audio input of the hearing instrument 104 which is separate from the microphone 36 of the hearing instrument 15 (such separate audio input has a high input impedance).

The first audio signals provided at the separate audio input of the hearing instrument 104 may undergo pre-amplification in a pre-amplifier 33, while the audio signals produced by the microphone 36 of the hearing instrument 104 may undergo pre-amplification in a pre-amplifier 37. The hearing instrument 104 further comprises a digital central unit 35 into which the audio signals from the microphone 36 and the audio input are supplied as a mixed audio signal for further audio signal processing and amplification prior to being supplied to the input of the output transducer 38 of the hearing instrument 104. The output transducer 38 serves to stimulate the user's hearing 39 according to the combined audio signals provided by the central unit 35.

Since pre-amplification in the pre-amplifiers 33 and 37 is not level-dependent the receiver unit 103 may control—by controlling the gain applied by the variable gain amplifier 126—also the ratio of the gain applied to the audio signals from the microphone arrangement 26 and the gain applied to the audio signals from the microphone 36.

Figure 11:
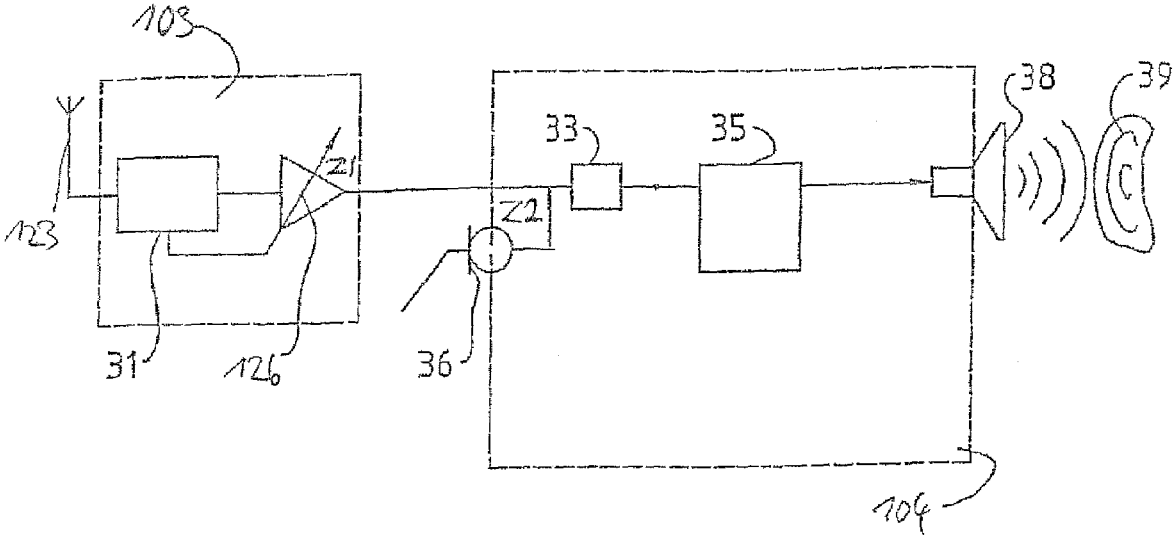
FIG. 11 shows schematically an example in which the receiver unit is connected in parallel to the microphone arrangement of a hearing instrument.

FIG. 11 shows a modification of the embodiment of FIG. 10, wherein the output of the receiver unit 103 is not provided to a separate high impedance audio input of the hearing instrument 104 but rather is provided to an audio input of the hearing instrument 104 which is connected in parallel to the hearing instrument microphone 36. Also in this case, the audio signals from the remote microphone arrangement 26 and the hearing instrument microphone 36, respectively, are provided as a combined/mixed audio signal to the central unit 35 of the hearing instrument 104. The gain ratio for the audio signals from the receiver unit 103 and the microphone 36, respectively, can be controlled by the receiver unit 103 by accordingly controlling the signal at the audio output of the receiver unit 103 and the output impedance Z1 of the audio output of the receiver unit 103, i.e. by controlling the gain applied to the audio signals by the amplifier 126 in the receiver unit 103.

Figure 12:
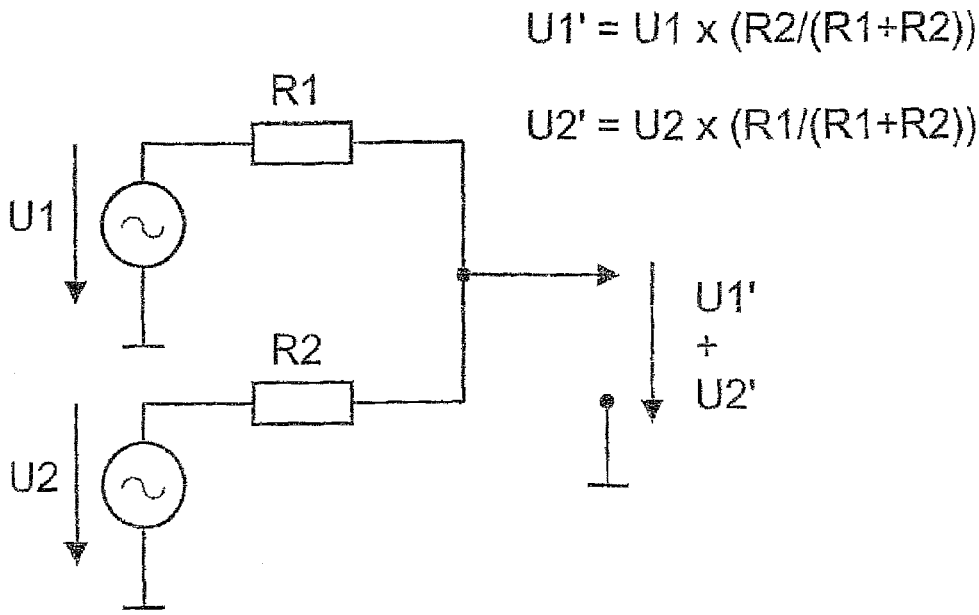
FIG. 12 is a schematic block diagram illustrating how the first and second audio signals in the embodiment of FIG. 11 are mixed and how the gain ratio can be controlled.

FIG. 12 is a schematic representation of how such gain ratio control is can be realized. In the representation of FIG. 12, U1 is the signal at the audio output of the receiver unit 103, Z1 is the audio output impedance of the receiver unit 103, U2 is the audio signal at the output of the second microphone 36, 72 is the impedance of the second microphone 36, and R1 is an approximation of Z1, while R2 is an approximation of Z2, which in both cases is a good approximation for the audio frequency range of the signals. $U_{out}$ is the combined audio signal and is given by U1'+U2', which, in turn, is given by $$U1\times(R2/(R1+R2))+U2\times(R1/(R1+R2)).$$

Consequently, the amplitude U1 and the impedance Z1(R1) of the output signal of the receiver unit 103 will determine the ratio of the amplitude U1 (i.e. the amplitude of the first audio signals from the remote microphone 26) and U2 (i.e. the amplitude of the second audio signals from the hearing instrument microphone 36), since the impedance Z2(R2) of the microphone 36 typically is 3.9 kOhm and the sensitivity of the microphone 36 is calibrated.

This means that in the case of an audio input in parallel to the second microphone 36 the audio signal U2 of the hearing instrument microphone 36 can be dynamically attenuated according to the control signal from the classification unit 134 by varying the amplitude U1 and the impedance Z1(R1) of the audio output of the receiver unit 103.

The transmission unit to be used with the receiver unit of FIG. 9 corresponds to that shown in FIG. 6. In particular, also the gain control scheme applied by the classification unit 134 of the transmission unit 102 may correspond to that shown in FIG. 7.

The permanently repeated determination of the present auditory scene category and the corresponding setting of the gain ratio allows to automatically optimize the level of the first audio signals and the second audio signals according to the present auditory scene. For example, if the classification unit 134 detects that the speaker 100 is silent, the gain for the audio signals from the remote microphone 26 may be reduced in order to facilitate perception of the sounds in the environment of the hearing instrument 104—and hence in the environment of the user 101. If, on the other hand, the classification unit 134 detects that the speaker 100 is speaking while significant surrounding noise around the user 101 is present, the gain for the audio signals from the microphone 26 may be increased and/or the gain for the audio signals from the hearing instrument microphone 36 may be reduced in order to facilitate perception of the speaker's voice over the surrounding noise.

Attenuation of the audio signals from the hearing instrument microphone 36 is preferable if the surrounding noise level is above a given threshold value (i.e. noisy environment), while increase of the gain of the audio signals from the remote microphone 26 is preferable if the surrounding noise level is below that threshold value (i.e. quiet environment). The reason for this strategy is that thereby the listening comfort can be increased.

Figure 13:
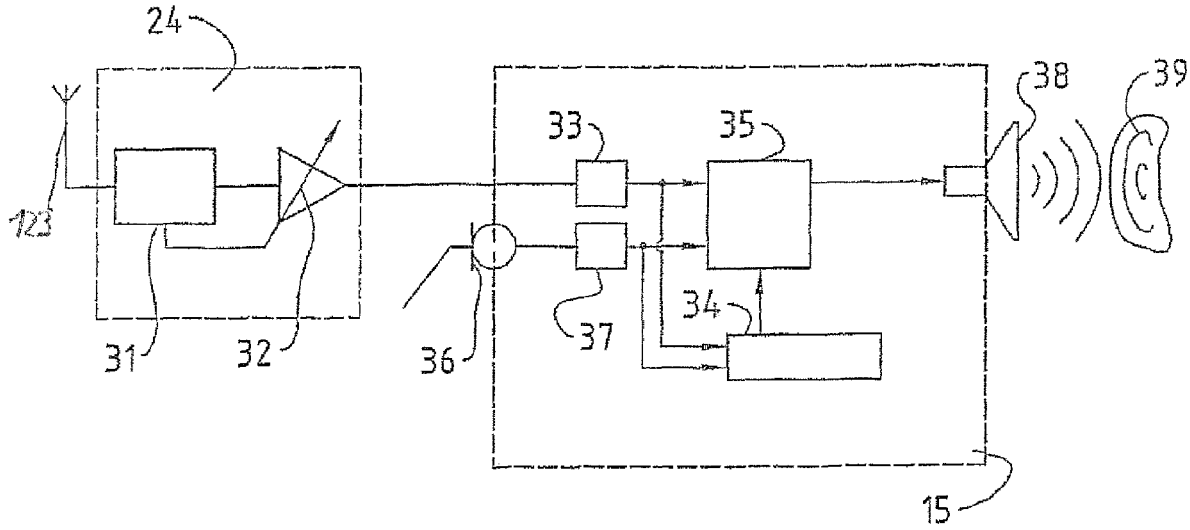
FIG. 13 shows a modification of the system of FIG. 10, wherein the classification unit is located in the hearing instrument.

In FIG. 13 a modified embodiment is shown wherein a conventional FM receiver unit 24 comprising an antenna 123, a unit 31 for demodulation, signal processing, etc., and a constant gain amplifier 32 is connected to a high impedance audio input of a hearing instrument 15 which is separate from the microphone 36 of the hearing instrument 15.

The first audio signals provided at the separate audio input of the hearing instrument 15 may undergo signal processing in a processing module 33, while the audio signals produced by the microphone 36 of the hearing instrument 15 (in the following referred to "second audio signals") may undergo signal processing in a processing module 37. The hearing instrument 15 further comprises a digital central unit 35 into which the first and second audio signals are introduced separately and which serves to combine/mix the first and second audio signals which then are provided as a combined audio signal from the output of the central unit 35 to the input of the output transducer 38 of the hearing instrument 15. The output transducer 38 serves to stimulate the user's hearing 39 according to the combined audio signals provided by the central unit 35. The central unit 35 also serves to set the ratio of the gain applied to the first audio signals and the second the gain applied to the second audio signals. To this end, a classification unit 34 is provided in the hearing instrument 15 which analyses the first and the second audio signals in order to determine a present auditory scene category selected from a plurality of auditory scene categories and which acts on the central unit 35 in such a manner that the central unit 35 sets the gain ratio according to the present auditory scene category determined by the classification unit 34. Thus the central unit 35 serves as a gain ratio control unit.

Consequently, in the embodiment of FIG. 13 the classification unit is provided in the hearing instrument 15 rather than in the transmission unit (not shown) associated to the receiver unit 24.

While in the above embodiments the receiver unit 24, 103 and the hearing instrument 15, 104 have been shown as separate devices connected by some kind of plug connection (usually an audio shoe) it is to be understood that the functionality of the receiver unit 24, 103 also could be integrated with the hearing instrument 15, 104, i.e. the receiver unit and the hearing instrument could form a single device.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A method for providing hearing assistance to a user, comprising:

(a) capturing audio signals by a microphone arrangement and transmitting said audio signals by a transmission unit via a wireless audio link to a receiver unit;

(b) analyzing said audio signals by a classification unit prior to being transmitted in order to determine a present auditory scene category from a plurality of auditory scene categories;

(c) setting by a gain control unit located in said receiver unit a gain applied to said audio signals according to said present auditory scene category determined in step (b);

(d) stimulating a user's hearing by stimulating means worn at or in a user's ear according to audio signals from said gain control unit.

2. The method of claim 1, wherein said classification unit is located in said transmission unit.

3. The method of claim 2, wherein said classification unit produces control commands according to said determined present auditory scene category for controlling said gain control unit, with said control commands being transmitted via a wireless data link from said transmission unit to said receiver unit.

4. The method of claim 3, wherein said wireless data link and said audio link are realized by a common transmission channel.

5. The method of claim 4 wherein a lower portion of a bandwidth of said transmission channel is used by said audio link and an upper portion of said bandwidth of said channel is used by said data link.

6. The method of claim 3, wherein said control commands received by said receiver unit undergo a parameter update in a parameter update unit according to parameter settings stored in a memory of said receiver unit prior to being supplied to said gain control unit.

7. The method of claim 1, wherein said stimulating means is part of said receiver unit.

8. The method of claim 7, wherein said gain control unit comprises an amplifier which is gain controlled.

9. The method of claim 1, wherein said receiver unit is part of a hearing instrument comprising said stimulating means.

10. The method of claim 9, wherein said hearing instrument comprises a second microphone arrangement for capturing second audio signals and means for mixing said second audio signals and said audio signals from said gain control unit.

11. The method of claim 10, wherein said hearing instrument includes means for processing said mixed audio signals prior to being supplied to said stimulating means.

12. The method of claim 10, wherein said gain control unit acts to dynamically attenuate said second audio signals as long as said classification unit determines a surrounding noise level above a given threshold.

13. The method of claim 12, wherein said gain control unit acts to change an output impedance and an amplitude of said receiver unit in order to attenuate said second audio signals, with an output of said receiver unit being connected in parallel with said second microphone arrangement.

14. The method of claim 9, wherein said gain control unit comprises an amplifier which is gain and output impedance controlled.

15. The method of claim 12, wherein said amplifier of said gain control unit acts on said audio signals received by said receiver unit in order to dynamically increase or decrease the level of said audio signals as long as said classification unit determines a surrounding noise level below a given threshold.

16. The method of claim 1, wherein said receiver unit is connected to a hearing instrument comprising said stimulating means.

17. The method of claim 1, wherein said stimulating means is an electroacoustic output transducer.

18. The method of claim 1, wherein said audio link is an FM radio link.

19. The method of claim 1, wherein said gain is set by said gain control unit to a finite value within a dynamic range of less than 20 dB.

20. The method of claim 1, wherein said classification unit uses at least one parameters for determining the present auditory scene category selected from the group consisting of presence of close voice at said microphone arrangement or not, and level of noise surrounding said user.

21. The method of claim 20, wherein said gain control unit sets said gain to a first value if close voice at said microphone arrangement is detected by said classification unit and to a second value if no close voice at said microphone arrangement is detected by said classification unit, with said second value being lower than said first value.

22. The method of claim 21, wherein said first value is changed by said gain control unit according to a surrounding noise level detected by said classification unit.

23. The method of claim 21, wherein said gain control unit reduces said gain progressively from said first value to said second value during a given release time period if said classification unit detects a change from close voice at said microphone arrangement to no close voice at said microphone arrangement.

24. The method of claim 23, wherein said gain control unit keeps said gain at said first value for a given hold-on time period if said classification unit detects a change from close voice at said microphone arrangement to no close voice at said microphone arrangement, prior to progressively reducing said gain from said first value to said second value during a release time period.

25. The method of claim 1, wherein said audio signals undergo an automatic gain control treatment in a gain model unit prior to being transmitted to said receiver unit.

26. The method of claim 1, wherein said microphone arrangement comprises two spaced apart microphones.

27. The method of claim 26, wherein audio signals produced by said spaced apart microphones are supplied to a beam-former unit which produces said audio signals of said microphone arrangement at its output.

28. The method of claim 27, wherein said classification unit comprises a voice energy estimator unit and wherein said audio signals produced by said beam-former unit are used by said voice energy estimator unit in order to decide whether there is a close voice captured by said microphone arrangement or not and to produce a corresponding control command.

29. The method of claim 28, wherein said classification unit comprises a surrounding noise level estimator unit and wherein said audio signals produced by at least one of said spaced apart microphones are used by said surrounding noise level estimator unit in order to determine a present surrounding noise level and to produce a corresponding control command.

30. The method of claim 29, wherein said surrounding noise level estimator unit is active only if said voice energy estimator unit has decided that there is no close voice captured by said microphone arrangement.

31. The method of claim 29, wherein said control commands produced by said voice energy estimator unit and said surrounding noise level estimator unit are added in an adder unit to said audio signals prior to being transmitted by said transmission unit.

32. The method of claim 1, wherein in step (b) said classification unit analyzes at least one of amplitudes, frequency spectra and transient phenomena of said audio signals.

33. A method for providing hearing assistance to a user, comprising:

(a) capturing first audio signals by a first microphone arrangement and transmitting the first audio signals by a transmission unit via a wireless audio link to a receiver unit connected to or integrated into a hearing instrument comprising means for stimulating a hearing of said user wearing said hearing instrument;

(b) capturing second audio signals by a second microphone arrangement of said hearing instrument;

(c) analyzing at least one of said first audio signals, prior to being transmitted, and said second audio signals by a classification unit in order to determine a present auditory scene category from a plurality of auditory scene categories;

(d) setting by a gain ratio control unit a ratio of a gain applied to said first audio signals and a gain applied to said second audio signals according to a present auditory scene category determined in step (c) and mixing said first and second audio signals according to said set gain ratio;

(e) stimulating a user's hearing by said stimulating means according to said mixed first and second audio signals.

34. The method of claim 33, wherein in step (c) at least said first audio signals are analyzed.

35. The method of claim 34, wherein said classification unit uses at least one parameter for determining the present auditory scene category selected from the group consisting of presence of close voice at said first microphone arrangement or not, and level of a noise surrounding said user.

36. The method of claim 35, wherein said gain ratio control unit sets said gain ratio to a first value if close voice at said first microphone arrangement is detected by said classification unit and to a second value if no close voice at said first microphone arrangement is detected by said classification unit, with said second value being lower than said first value.

37. The method of claim 36, wherein said second value is changed by said gain ratio control unit according to a surrounding noise level detected by said classification unit.

38. The method of claim 37, wherein said gain ratio control unit reduces said gain ratio progressively from said first value to said second value during a given release time period if said classification unit detects a change from close voice at said first microphone arrangement to no close voice at said first microphone arrangement.

39. The method of claim 38, wherein said gain ratio control unit keeps the gain ratio at said first value for a given hold-on time period if said classification unit detects a change from close voice at said first microphone arrangement to no close voice at said first microphone arrangement, prior to progressively reducing said gain ratio from said first value to said second value during a release time period.

40. The method of claim 33, wherein said classification unit is located in said transmission unit.

41. The method of claim 40, wherein said gain ratio control unit is located in said receiver unit.

42. The method of claim 41, wherein said classification unit produces control commands according to said determined present auditory scene category for controlling said gain ratio control unit, with said control commands being transmitted via a wireless data link from said transmission unit to said receiver unit.

43. The method of claim 42, wherein said wireless data link and said audio link are realized by a common transmission channel.

44. The method of claim 43, wherein a lower portion of a bandwidth of said transmission channel is used by said audio link and an upper portion of said bandwidth of said channel is used by said data link.

45. The method of claim 41, wherein said gain ratio control unit comprises an amplifier which is gain and output impedance controlled.

46. The method of claim 45, wherein said amplifier of said gain ratio control unit acts on said first audio signals received by said receiver unit prior to being supplied to said hearing instrument in order to dynamically increase or decrease a level of said first audio signals as long as said classification unit determines a surrounding noise level below a given threshold.

47. The method of claim 46, wherein said gain ratio control unit acts on said second audio signals in order to dynamically attenuate said second audio signals as long as said classification unit determines a surrounding noise level above a given threshold.

48. The method of claim 47, wherein said gain ratio control unit acts to change an output impedance and an amplitude of said receiver unit in order to attenuate said second audio signals, with said output of said receiver unit being connected in parallel with said second microphone arrangement.

49. The method of claim 33, wherein said classification unit and said gain ratio control unit are located in said hearing instrument.

50. The method of claim 49, wherein said first audio signals are supplied to said hearing instrument via an audio input separate from said second microphone arrangement.

51. The method of claim 50, wherein said first and second audio signals in step (d) are mixed by a central digital unit of said hearing instrument, which serves as said gain ratio control unit, and wherein said classification unit acts on said central digital unit.

52. The method of claim 51, wherein said gain ratio control unit acts on said first audio signals in order to dynamically increase or decrease a level of said first audio signals as long as said classification unit determines a surrounding noise level below a given threshold.

53. The method of claim 52, wherein said gain ratio control unit acts on said second audio signals in order to dynamically attenuate said second audio signals as long as said classification unit determines a surrounding noise level above a given threshold.

54. The method of claim 33, wherein in step (d) said gain control unit acts on both said first and said second audio signals.

55. A system for providing hearing assistance to a user, comprising: a microphone arrangement for capturing audio signals, a transmission unit for transmitting said audio signals via a wireless audio link to a receiver unit worn by said user; a classification unit for analyzing said audio signals prior to being transmitted in order to determine a present auditory scene category from a plurality of auditory scene categories, a gain control unit located in said receiver unit for setting a value of a gain applied to said audio signals received by said receiver unit according to said present auditory scene category determined by said classification unit, and means worn at or in a user's ear for stimulating a hearing of said user according to audio signals from said gain control unit.

56. The system of claim 55, wherein said microphone arrangement is integrated within said transmission unit.

57. A system for providing hearing assistance to a user, comprising: a first microphone arrangement for capturing first audio signals, a transmission unit for transmitting the first audio signals via a wireless audio link to a receiver unit connected to or integrated into a hearing instrument, a second microphone arrangement of said heating instrument for capturing second audio signals, a classification unit for analyzing at least one of said first audio signals prior to being transmitted and said second audio signals in order to determine a present auditory scene category from a plurality of auditory scene categories, a gain ratio control unit for setting a ratio of a gain applied to said first audio signals and a gain applied to said second audio signals according to said present auditory scene category determined by said classification unit, means for mixing said first and second audio signals according to said gain ratio set by said gain ratio control unit, and means included in said hearing instrument for stimulating a hearing of said user wearing said hearing instrument according to said mixed first and second audio signals.

58. The system of claim 57, wherein said first microphone arrangement is integrated within said transmission unit.

* * * * *